US011238787B2

(12) United States Patent
An

(10) Patent No.: US 11,238,787 B2
(45) Date of Patent: Feb. 1, 2022

(54) DETERIORATION COMPENSATION APPARATUS, DISPLAY APPARATUS HAVING THE SAME AND METHOD OF COMPENSATING DETERIORATION OF DISPLAY APPARATUS USING THE SAME

(71) Applicant: Samsung Display Co., Ltd., Yongin-si (KR)

(72) Inventor: Boyoung An, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 146 days.

(21) Appl. No.: 16/247,330

(22) Filed: Jan. 14, 2019

(65) Prior Publication Data

US 2019/0221158 A1 Jul. 18, 2019

(30) Foreign Application Priority Data

Jan. 17, 2018 (KR) ..... 10-2018-0006290

(51) Int. Cl.

| | |
|---|---|
| ***G09G 3/3225*** | (2016.01) |
| ***G09G 3/3266*** | (2016.01) |
| ***G09G 3/3275*** | (2016.01) |
| ***G09G 3/00*** | (2006.01) |

(52) U.S. Cl.

CPC ..... *G09G 3/3225* (2013.01); *G09G 3/003* (2013.01); *G09G 3/3266* (2013.01); *G09G 3/3275* (2013.01); *G09G 2310/08* (2013.01); *G09G 2320/0233* (2013.01); *G09G 2320/0257* (2013.01); *G09G 2320/0285* (2013.01);

(Continued)

(58) Field of Classification Search

None

See application file for complete search history.

(56) References Cited

U.S. PATENT DOCUMENTS 5,446,495 A * 8/1995 Tourtier ..... H04N 19/61 375/240.11

2005/0088379 A1* 4/2005 Tsuchida ..... G09G 3/3291 345/76

(Continued)

FOREIGN PATENT DOCUMENTS

KR 10-2017-0067189 A 6/2017

KR 10-2017-0081094 A 7/2017

*Primary Examiner* — Benjamin C Lee

*Assistant Examiner* — Emily J Frank

(74) *Attorney, Agent, or Firm* — Lewis Roca Rothgerber Christie LLP

(57) ABSTRACT

A deterioration compensation apparatus includes a zone determiner, a stress generator, a first memory and a stress compensator. The zone determiner divides a display area into zones based on a distance from a central portion of the display area. The stress generator generates stress values of output image data for blocks including a plurality of pixels in the display area. The first memory accumulates the stress values of the output image data for the blocks and stores the accumulated stress values of the output image data for the blocks. The stress compensator receives the accumulated stress values of the output image data for the blocks and compensates input image data in a unit of pixels. A number of the pixels included in a block of the blocks varies according to the zone in which the pixels included in the block are located.

23 Claims, 11 Drawing Sheets

(52) U.S. Cl.
CPC . *G09G 2320/045* (2013.01); *G09G 2320/048* (2013.01); *G09G 2360/16* (2013.01)

(56) References Cited

U.S. PATENT DOCUMENTS

| | | | | |
|---|---|---|---|---|
| 2012/0320983 | A1* | 12/2012 | Zheng | H04N 19/105 375/240.16 |
| 2013/0250187 | A1* | 9/2013 | Hanaoka | G09G 3/3413 348/790 |
| 2013/0265323 | A1* | 10/2013 | Morikawa | G09G 3/3611 345/601 |
| 2016/0358558 | A1* | 12/2016 | Takasaki | G09G 3/3648 |
| 2016/0358582 | A1* | 12/2016 | Lee | G06F 3/1446 |
| 2018/0174535 | A1* | 6/2018 | Chen | G09G 3/007 |
| 2018/0218504 | A1* | 8/2018 | Makino | G06T 7/194 |
| 2019/0052872 | A1* | 2/2019 | Shyshkin | G01J 1/0228 |
| 2019/0073971 | A1* | 3/2019 | Bai | G09G 3/3688 |
| 2019/0080666 | A1* | 3/2019 | Chappalli | G09G 3/22 |
| 2019/0221158 | A1* | 7/2019 | An | G09G 3/3275 |
| 2019/0279583 | A1* | 9/2019 | Shang | G09G 3/006 |

* cited by examiner

FIG. 9

B1 B2

| | | | | | | | |
|---|---|---|---|---|---|---|---|
| (1,1) | (1,2) | | | | | | (1,8) |
| (2,1) | | | | | | | (2,8) |
| T | | | | | P | | U |
| | | | | | | | |
| | | | | | | | |
| | | | | | | | |
| (7,1) | | | | | | | (7,8) |
| (8,1) | (8,2) | | | | | (8,7) | (8,8) |

B3 B4

DETERIORATION COMPENSATION APPARATUS, DISPLAY APPARATUS HAVING THE SAME AND METHOD OF COMPENSATING DETERIORATION OF DISPLAY APPARATUS USING THE SAME

CROSS-REFERENCE TO RELATED APPLICATION

This application claims priority to and the benefit of Korean Patent Application No. 10-2018-0006290, filed on Jan. 17, 2018 in the Korean Intellectual Property Office (KIPO), the contents of which are incorporated herein by reference in their entireties.

BACKGROUND

1. Field

The present disclosure relates to a deterioration compensation apparatus, a display apparatus including the deterioration compensation apparatus and a method of compensating for deterioration of the display apparatus using the deterioration compensation apparatus.

2. Description of the Related Art

A display apparatus includes a display panel and a display panel driver. The display panel includes a plurality of gate lines, a plurality of data lines and a plurality of pixels. The display panel driver includes a gate driver, a data driver and a timing controller. The gate driver outputs gate signals to the gate lines. The data driver outputs data voltages to the data lines. The timing controller controls driving timings of the gate driver and the data driver.

For example, the display apparatus may be an organic light emitting display apparatus including organic light emitting diodes or a liquid crystal display apparatus including liquid crystal molecules. Luminance difference or after-image may be generated due to deterioration of an element of a pixel such as the organic light emitting diode in the organic light emitting display apparatus. To enhance the display quality, input image data may be compensated.

The organic light emitting display apparatus may be applied to a head mounted display apparatus. It may be desirable to enhance the display quality of the head mounted display apparatus, and it may be desirable to reduce the size of a memory of the head mounted display apparatus.

SUMMARY

Exemplary embodiments of the present inventive concept provide a deterioration compensation apparatus for compensating input image data by dividing a display area into a plurality of zones and varying a size of a block according to the zone.

Exemplary embodiments of the present inventive concept also provide a display apparatus including the above-mentioned deterioration compensation apparatus.

Exemplary embodiments of the present inventive concept also provide a method of compensating for deterioration of the display apparatus using the above-mentioned deterioration compensation apparatus.

According to exemplary embodiments of the present disclosure, a deterioration compensation apparatus includes a zone determiner, a stress generator, a first memory and a stress compensator. The zone determiner divides a display area into zones based on a distance from a central portion of the display area. The stress generator generates stress values of output image data for blocks including a plurality of pixels in the display area. The first memory accumulates the stress values of the output image data for the blocks and stores the accumulated stress values of the output image data for the blocks. The stress compensator receives the accumulated stress values of the output image data for the blocks and compensates input image data in a unit of pixels. A number of the pixels included in a block of the blocks varies according to the zone in which the pixels included in the block are located.

In some embodiments, the number of the pixels included in a block of the blocks may increase as the distance from the central portion of the display area increases.

In some embodiments, the deterioration compensation apparatus may further include a second memory which receives the accumulated stress values of the output image data for the blocks from the first memory and transmits the accumulated stress values of the output image data for the blocks to the stress compensator.

In some embodiments, the first memory may be a non-volatile memory. The second memory may be a volatile memory.

In an exemplary embodiment, a storage size of the first memory may be greater than a storage size of the second memory.

In some embodiments, the deterioration compensation apparatus may further include a block averaging addressing part which determines a size of the block according to the zone in which the block is located, and addresses the pixels to the block based on the size of the block.

In some embodiments, the stress compensator may include a block averaging decoder which receives the accumulated stress values of the output image data for the blocks and decodes the accumulated stress values of the output image data for the blocks into accumulated stress values of the output image data for the pixels, a usage determiner that converts the accumulated stress values of the output image data for the pixels into usages of light emitting elements in the display area, a compensating value determiner that generates deterioration compensating values for the pixels based on the usages of light emitting elements and an operator which adjusts the input image data based on the deterioration compensating values.

In some embodiments, the block averaging addressing part may provide information on addressing between the pixels and the blocks to the block averaging decoder.

In some embodiments, the stress generator may include a first converter which receives the output image data and converts the output image data into luminance values for the pixels, a second converter which converts the luminance values for the pixels into the stress values of the output image data for the pixels using an accelerating factor and a block averaging encoder which encodes the stress values of the output image data for the pixels into the stress values of the output image data for the blocks.

In some embodiments, the block averaging addressing part may provide information on addressing between the pixels and the blocks to the block averaging encoder.

In some embodiments, the accelerating factor may be a temperature of a display panel or a driving voltage of the display panel.

In some embodiments, the deterioration compensating value for the pixel to compensate the input image data may be determined by bilinear interpolation of the deterioration compensation values of four adjacent blocks.

In some embodiments, when the deterioration compensation value of the pixel is P(a, b), a is a row direction coordinate in a plane defined by central points of the four adjacent blocks, b is a column direction coordinate in the plane defined by the central points of the four adjacent blocks, B1 is a deterioration compensating value of a first block, B2 is a deterioration compensating value of a second block adjacent to the first block in the row direction, B3 is a deterioration compensating value of a third block adjacent to the first block in the column direction, B4 is a deterioration compensating value of a fourth block adjacent to the third block in the row direction and adjacent to the second block in the column direction, r is the number of the rows of the blocks, c is the number of the columns of the blocks, T is a deterioration compensating value of first temporary coordinates between the central point of the first block and the central point of the third block and U is a deterioration compensating value of second temporary coordinates between the central point of the second block and the central point of the fourth block, $$P(a, b) = T\frac{c-b}{c} + U\frac{b}{c},\ T = B1\frac{r-a}{r} + B3\frac{a}{r} \text{ and } U = B2\frac{r-a}{r} + B4\frac{a}{r}.$$

According to exemplary embodiments of the present disclosure, a display apparatus includes a display panel, a deterioration compensation apparatus, a gate driver and a data driver. The display panel displays an image. The deterioration compensation apparatus includes a stress generator that generates stress values of output image data of the display panel, a first memory which accumulates the stress values of the output image data and stores the accumulated stress values of the output image data, a stress compensator to compensate input image data based on the accumulated stress values of the output image data, and a second memory that receives the accumulated stress values of the output image data from the first memory and transmits the accumulated stress values of the output image data to the stress compensator. The gate driver outputs a gate signal to the display panel. The data driver converts the output image data into a data voltage and outputs the data voltage to the display panel.

In some embodiments, the deterioration compensation apparatus may further include a zone determining part which divides a display area into zones based on a distance from a central portion of the display area.

In some embodiments, the stress generator may generate the stress values of the output image data for blocks including a plurality of pixels in the display area. The first memory may accumulate the stress values of the output image data for the blocks. The stress compensator may compensate the input image data in a unit of the pixels. A number of the pixels included in a block of the blocks may vary according to the zone in which the pixels included in the block are located.

In some embodiments, the display panel may include a left eye display area and a right eye display area. The display apparatus may further include a left eye lens configured to be between the left eye display area and a left eye of a user and a right eye lens configured to be between the right eye display area and a right eye of the user.

In some embodiments, the display apparatus may further include a second display panel spaced apart from the display panel, a left eye lens configured to be between the display panel and a left eye of a user and a right eye lens configured to be between the second display panel and a right eye of the user.

In some embodiments, the zone determiner, the stress generator, the stress compensator, the gate driver and the data driver may be formed on a single chip.

In some embodiments, the number of the pixels included in the block may increase as the distance from the central portion of the display area increases.

In some embodiments, the deterioration compensation apparatus may further include a block averaging addressing part which determines a size of the block according to the zone in which the block is located, and addresses the pixels to the block based on the size of the block.

In some embodiments, the stress compensator may include a block averaging decoder to receive the accumulated stress values of the output image data for the blocks and to decode the accumulated stress values of the output image data for the blocks into accumulated stress values of the output image data for the pixels, a usage determiner to convert the accumulated stress values of the output image data for the pixels into usages of light emitting elements in the display area, a compensating value determiner to generate deterioration compensating values for the pixels based on the usages of light emitting elements and an operator to adjust the input image data based on the deterioration compensating values.

In some embodiments, wherein the stress generator may include a first converter to receive the output image data and to convert the output image data into luminance values for the pixels, a second converter which converts the luminance values for the pixels into the stress values of the output image data for the pixels using an accelerating factor and a block averaging encoder which encodes the stress values of the output image data for the pixels into the stress values of the output image data for the blocks.

According to exemplary embodiments of the present disclosure, a method of compensating for deterioration of a display apparatus includes dividing a display area into zones based on a distance from a central portion of the display area, generating stress values of output image data for blocks including a plurality of pixels in the display area, accumulating the stress values of the output image data for the blocks and storing the accumulated stress values of the output image data for the blocks, and receiving the accumulated stress values of the output image data for the blocks and compensating input image data in a unit of pixels. A number of the pixels included in a block of the blocks varies according to the zone in which the pixels included in the block are located.

According to the deterioration compensation apparatus, the display apparatus including the deterioration compensation apparatus and the method of compensating for deterioration of the display apparatus using the deterioration compensation apparatus, the display area is divided into a plurality of zones and a size of a block varies according to the zones so that the input image data may be compensated. Thus, the display quality of the display apparatus which may be vulnerable to deterioration may be enhanced.

In addition, the size of the block is adjusted according to the zones so that the size of the memory of the display apparatus may be reduced. Thus, the manufacturing cost of the display apparatus may be reduced.

In addition, the size of the block is adjusted according to the zones so that quantity of data and a clock speed to process the data to compensate for the deterioration are reduced. Thus, the power consumption of the display apparatus may be reduced.

BRIEF DESCRIPTION OF THE DRAWINGS

The above and other features and aspects of the present inventive concept will become more apparent by describing in detailed exemplary embodiments thereof with reference to the accompanying drawings, in which:

FIG. 9 is a conceptual diagram illustrating a method of determining a deterioration compensating value for a pixel based on a deterioration compensating value for a block using the timing controller of FIG. 5;

DETAILED DESCRIPTION

Hereinafter, exemplary embodiments of the present inventive concept will be explained in detail with reference to the accompanying drawings.

Figure 1:
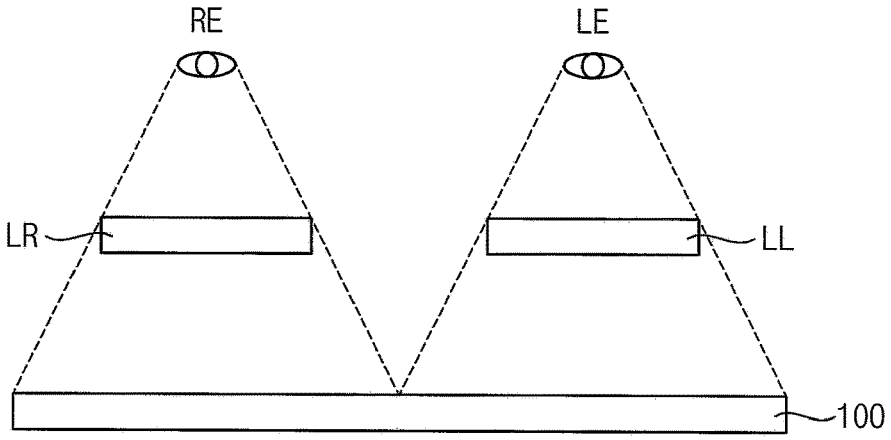
FIG. 1 is a conceptual diagram illustrating a display apparatus according to an exemplary embodiment of the present inventive concept.

FIG. 1 is a conceptual diagram illustrating a display apparatus according to an exemplary embodiment of the present inventive concept.

Referring to FIG. 1, the display apparatus may include a display panel 100, a left eye lens LL and a right eye lens LR. For example, the display apparatus may be a head mounted display apparatus. The display apparatus may be mounted to a head of a user.

The display panel 100 displays an image.

The left eye lens LL is disposed between a left eye LE of the user and the display panel 100. The left eye lens LL refracts (or, in some embodiments, otherwise passes) an image of a first display area of the display panel 100 and transmits the image of the first display area to the left eye LE of the user. For example, the left eye lens LL may magnify the image of the first display area and transmit the image of the first display area to the left eye LE of the user.

The right eye lens LR is disposed between a right eye RE of the user and the display panel 100. The right eye lens LR refracts (or, in some embodiments, otherwise passes) an image of a second display area of the display panel 100 and transmits the image of the second display area to the right eye RE of the user. For example, the right eye lens LR may magnify the image of the second display area and transmit the image of the second display area to the right eye RE of the user.

In the present exemplary embodiment, the display apparatus may include a single display panel 100. The display panel 100 may include the first display area for displaying a left eye image and the second display area for displaying a right eye image.

Figure 2:
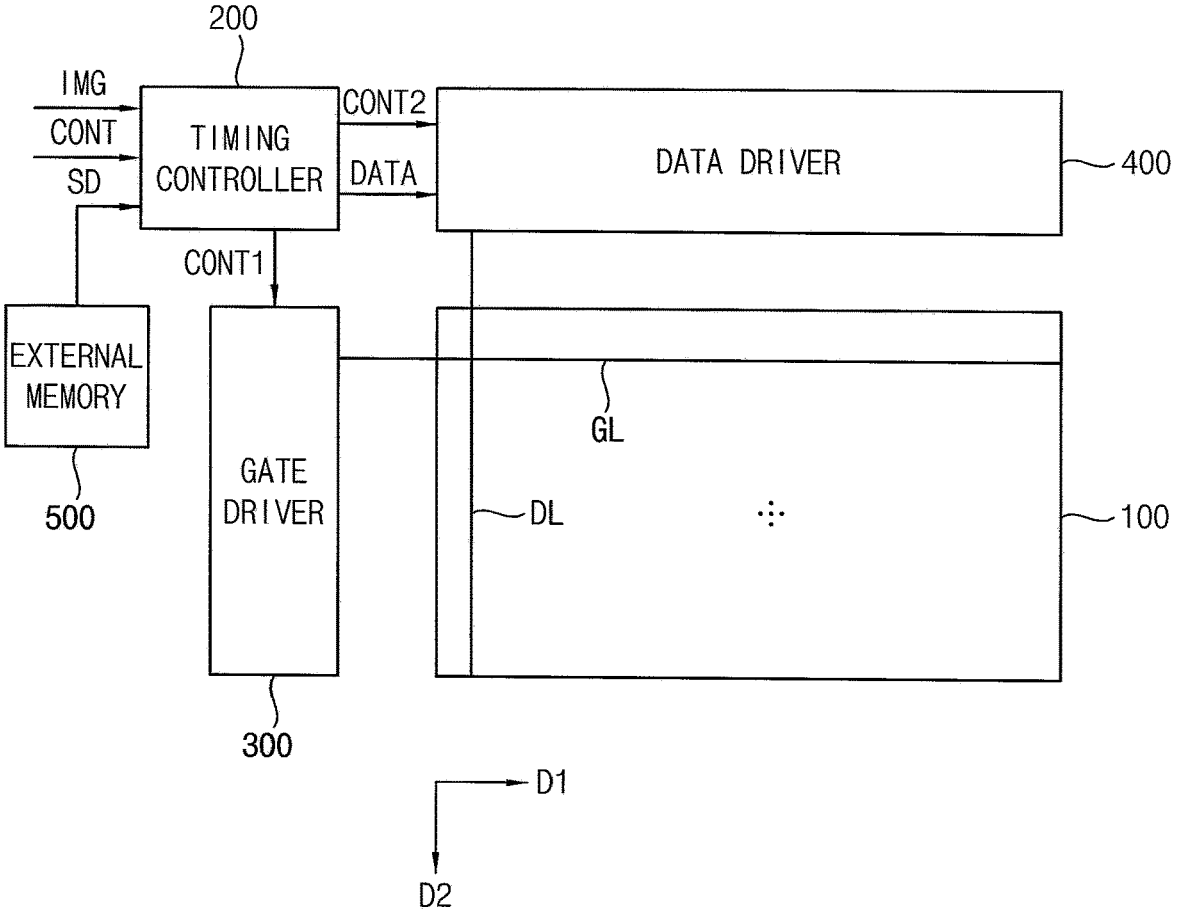
FIG. 2 is a block diagram illustrating the display apparatus of FIG. 1.

FIG. 2 is a block diagram illustrating the display apparatus of FIG. 1.

Referring to FIGS. 1 and 2, the display apparatus includes the display panel 100 and a display panel driver. The display panel driver includes a timing controller 200, a gate driver 300, a data driver 400 and an external memory 500. A deterioration compensation apparatus of the present exemplary embodiment may include the timing controller 200 and the external memory 500.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The display panel 100 may include a first display area disposed at a first side with respect to a central line extending in the second direction D2 and a second display area disposed at a second side with respect to the central line.

The timing controller 200 receives input image data IMG and an input control signal CONT from an external apparatus (not shown). The input image data IMG may include red image data, green image data and blue image data. The input image data IMG may include red image data, green image data, blue image data and white image data. The input image data IMG may include one of magenta image data, yellow image data and cyan image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal.

The timing controller 200 generates the second control signal CONT2 for controlling an operation of the data driver 400 based on the input control signal CONT, and outputs the second control signal CONT2 to the data driver 400. The second control signal CONT2 may include a horizontal start signal and a load signal.

The timing controller 200 generates the data signal DATA based on the input image data IMG. The timing controller 200 outputs the data signal DATA to the data driver 400.

The timing controller 200 may apply a deterioration compensating value to the image data IMG to generate the data signal DATA. An embodiment of the structure and the operation of the timing controller 200 are explained referring to FIGS. 5 to 10 in detail.

The gate driver 300 generates gate signals driving the gate lines GL in response to the first control signal CONT1 received from the timing controller 200. The gate driver 300 outputs the gate signals to the gate lines GL. For example, the gate driver 300 may sequentially output the gate signals to the gate lines GL.

The data driver 400 receives the second control signal CONT2 and the data signal DATA from the timing controller 200. The data driver 400 converts the data signal DATA into data voltages having an analog type using gamma reference voltages corresponding to the data signal DATA. The data driver 400 outputs the data voltages to the data lines DL.

Figure 3:
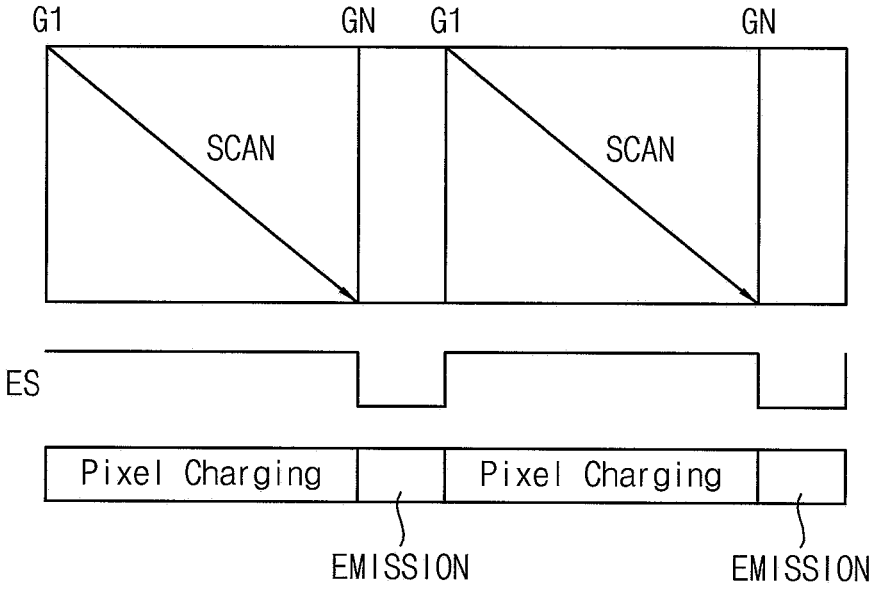
FIG. 3 is a conceptual diagram illustrating a method of driving a display panel of FIG. 2.

FIG. 3 is a conceptual diagram illustrating a method of driving the display panel 100 of FIG. 2.

Referring to FIGS. 1 to 3, the display apparatus may be an organic light emitting display apparatus. The display apparatus may be a head mounted display apparatus. The display apparatus may be driven in a concurrent emitting method (e.g., a simultaneous emitting method). For example, the head mounted display apparatus may be driven at a high frame frequency such as 90 Hz or greater to display a virtual reality. In addition, the head mounted display apparatus may be driven in the concurrent emitting method (e.g., the simultaneous emitting method) to prevent a motion blur defect in the high frame frequency.

As shown in FIG. 3, a frame includes a pixel charging period and an emission period. During the pixel charging period, first to N-th gate signals G1 to GN are applied to first to N-th gate lines and data voltages are charged to the pixels connected to the first to N-th gate lines in response to the first to N-th gate signals G1 to GN. After the pixels are charged, the pixels concurrently (e.g., simultaneously) emit the light, for example, during the emission period.

The pixel may include a driving switching element. The driving switching element is turned on in response to an emission signal ES and the pixel emits light when the driving switching element is turned on. For example, if the driving switching element is a PMOS switching element, the data voltages may be charged to the pixels when the emission signal ES has a high level and the pixels may emit the light when the emission signal ES has a low level. Alternatively, if the driving switching element is an NMOS switching element, the data voltages may be charged to the pixels when the emission signal ES has the low level and the pixels may emit the light when the emission signal ES has the high level.

Figure 4:
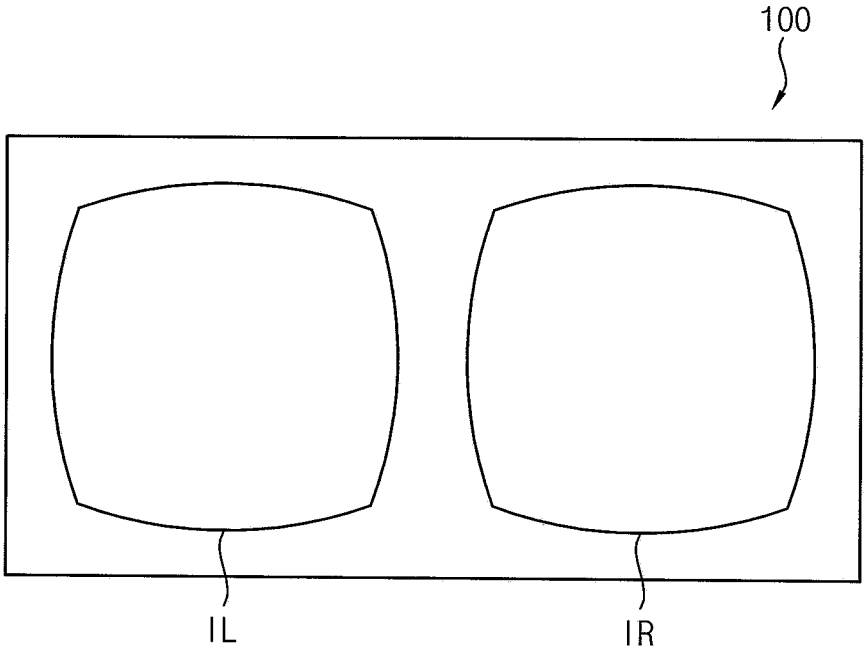
FIG. 4 is a conceptual diagram illustrating the display panel of FIG. 2.

FIG. 4 is a conceptual diagram illustrating the display panel 100 of FIG. 2.

Referring to FIGS. 1 to 4, the display panel 100 may include the first display area IL to display the left eye image and the second display area IR to display the right eye image. In the head mounted display apparatus, the user observes the refracted images through the left eye lens LL and the right eye lens LR so that edges of the first display area IL and the right display area IR may be curved, not straight.

Human eyes include cone cells for mainly identifying high luminance light and determining color and rod cells for mainly identifying low luminance light and determining luminance degree. The cone cells are concentrated at a central area of the retina. Thus, visual cognitive ability at an edge portion of the display area is much lower than the visual cognitive ability at a central portion of the display area according to human visual characteristics.

In addition, according to typical human visual characteristics, when an object is perceived in a viewing angle of over 20 degrees, a human will move his or her head to watch the object, not only his or her eyes. Considering human visual characteristics, visibility of the central portion of the display area is high and the visibility of other portions of the display area decreases as the distance from the central portion of the display area increases. As explained above, the visibility of the edge portion of the display area is very low, so that the outermost portions of the first display area IL and the second display area IR of FIG. 4 may display a black image or no image.

Figure 5:
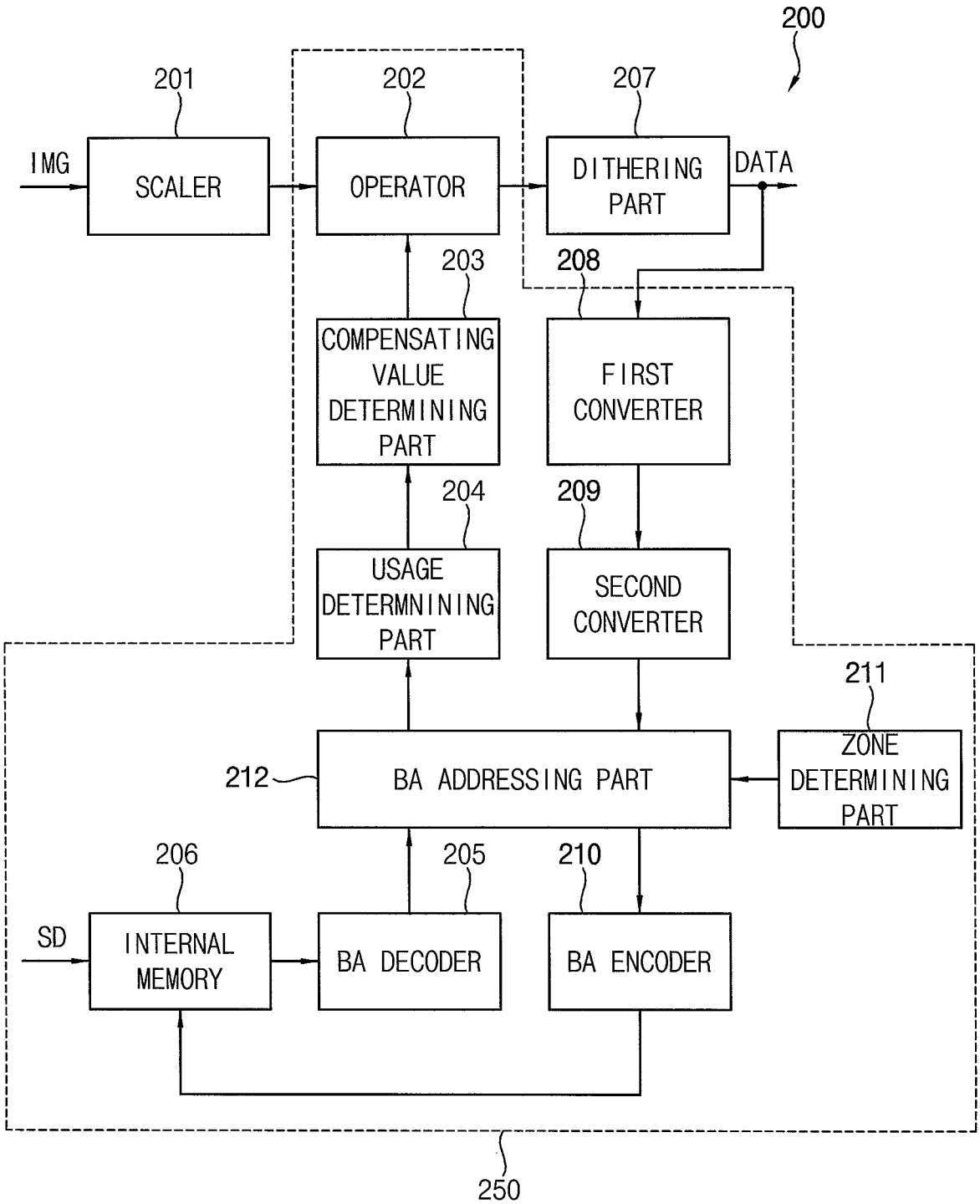
FIG. 5 is a block diagram illustrating a timing controller of FIG. 2.

FIG. 5 is a block diagram illustrating the timing controller 200 of FIG. 2. More specifically, FIG. 5 illustrates a scaler 201, a deterioration compensation part (i.e., a deterioration compensator) 250 and a dithering part 207. The elements in FIG. 5 except for the scaler 201 and the dithering part 207 may be included in the deterioration compensation part 250.

Referring to FIGS. 1 to 5, the timing controller 200 includes the deterioration compensation part 250. The deterioration compensation apparatus of the present exemplary embodiment may include the deterioration compensation part 250 of the timing controller 200 and the external memory 500.

The deterioration compensation part 250 includes a zone determining part (i.e., a zone determiner) 211, a stress generating part (i.e., a stress generator) and a stress compensation part (i.e., a stress compensator). The stress generating part may include a first converter 208, a second converter 209 and a block averaging encoder (BA encoder) 210. The stress compensation part may include a block averaging decoder (BA decoder) 205, a usage determining part (i.e., a usage determiner) 204, a compensating value determining part (i.e., a compensating value determiner) 203 and an operator 202. The deterioration compensation part 250 may further include an internal memory 206 and the block averaging addressing part 212.

The zone determining part 211 divides the display area into a plurality of zones based on a distance from the central portion of the display area. The zone determining part 211 may receive a zone setting file from a register to divide the display area into the zones. The zone setting file may be generated by a manufacturer. Alternatively, the zone setting file may be generated by the user.

The stress generating part generates a stress value of output image data for blocks (e.g., every block) including a plurality of pixels in the display area.

The external memory 500 connected to the timing controller 200 stores the accumulated stress values for the blocks.

The stress compensation part receives the accumulated stress values for the blocks and compensates the input image data in a unit of the pixel.

The size of a block may be defined as the number of pixels included in the block. The number of pixels included in a block may vary according to the zone of the display area which is determined by the zone determining part 211. For example, the number of the pixels included in a block of a zone may increase as the distance of the zone from the central portion of the display area increases.

The external memory 500 may be a nonvolatile memory so that the external memory 500 may avoid loss of the stored data when the display apparatus is turned off. For example, the external memory 500 may be a flash memory.

The internal memory 206 in the deterioration compensation part 250 may receive the accumulated stress values SD for the blocks and may transmit the accumulated stress values to the stress compensation part.

For example, the internal memory 206 may be a volatile memory so that the internal memory 206 may lose the stored data when the display apparatus is turned off. For example, the internal memory 206 may be a random access memory (RAM).

For example, a storage size of the external memory 500 may be greater than a storage size of the internal memory 206. The storage size of the internal memory 206 may correspond to the accumulated stress values SD for the blocks. The storage size of the external memory 500 may correspond to the accumulated stress values SD for the blocks and a spare space for a risk.

The block averaging addressing part 212 in the deterioration compensation part 250 may set the size of the block according to the zone and may address the pixels to the blocks based on the size of the block. The block averaging addressing part 212 may receive the information on zones of the display area from the zone determining part 211.

The stress compensation part may include the block averaging decoder 205, the usage determining part 204, the compensating value determining part 203 and the operator 202.

The internal memory 206 may be disposed between the external memory 500 and the block averaging decoder 205. When the display apparatus is turned on, the internal memory 206 receives the accumulated stress value SD for the blocks from the external memory 500. The internal memory 206 outputs the accumulated stress value SD for the blocks to the block averaging decoder 205.

The block averaging decoder 205 receives the accumulated stress value SD for the blocks and decodes the accumulated stress value SD for the blocks into an accumulated stress value for the pixels.

The block averaging addressing part 212 may provide information on the addressing between the pixels and the blocks to the block averaging decoder 205. The block averaging decoder 205 may decode the accumulated stress value SD for the blocks into the accumulated stress value for the pixels based on the information on the addressing between the pixels and the blocks (e.g., based on which block a given pixel is located in).

The usage determining part 204 converts the accumulated stress value for the pixels into a usage of the light emitting element (e.g. the organic light emitting diode) in the display area. The usage determining part 204 may convert the accumulated stress value for the pixels into usages of the light emitting elements for the pixels. A remaining life time of the light emitting element may be determined using the usage of the light emitting element. For example, when the usage of the light emitting element is great (e.g., representing significant use), a degree of the deterioration of the light emitting element may be great, and the remaining lifetime may be low. For example, when the usage of the light emitting element is minor (e.g., representing less use), a degree of the deterioration of the light emitting element may be minor, and the remaining lifetime may be high.

The compensating value determining part 203 receives the usages of the light emitting elements for the pixels from the usage determining part 204. The compensating value determining part 203 generates the deterioration compensating values for the pixels based on the usages of the light emitting elements. For example, the deterioration compensating values may increase grayscale values of input image data IMG such that the display panel 100 displays a target luminance. Alternatively, the deterioration compensating values may decrease grayscale values of input image data IMG to decrease luminance of the pixel which is brighter than adjacent pixels.

For example, when the usage of the light emitting element and the degree of the deterioration of the light emitting element are great, a relatively great deterioration compensating value may be applied to the pixel including the light emitting element having the great degree of the deterioration. For example, when the usage of the light emitting element and the degree of the deterioration of the light emitting element are small, a relatively small deterioration compensating value may be applied to the pixel including the light emitting element having the small degree of the deterioration.

For example, the compensating value determining part 203 may generate the deterioration compensating value using a lookup table including information on the deterioration compensating values corresponding to the usages.

The operator 202 receives the deterioration compensating values for the pixels. The operator 202 operates the input image data IMG and the deterioration compensating values to compensate the input image data IMG (e.g., adjusts the input image data IMG based on the deterioration values).

The stress generating part may include the first converter 208, the second converter 209 and the block averaging encoder 210.

The first converter 208 receives the output image data DATA which is outputted to the data driver 400 from the timing controller 200. The first converter 208 converts the output image data DATA into luminance values for the pixels. The first converter 208 may convert the output image data DATA into luminance values for the pixels using dimming information in the display area.

The second converter 209 receives the luminance values for the pixels from the first converter 208. The second converter 209 may convert the luminance values for the pixels into the stress values for the pixels by applying an accelerating factor. For example, the accelerating factor may be information regarding ambient circumstances and conditions of the display apparatus which affect the stress. For example, the accelerating factor may include a temperature of the display panel 100 and/or a driving voltage of the display panel 100.

The block averaging encoder 210 encodes the stress values for the pixels into the stress values for the blocks.

The block averaging addressing part 212 may provide information on the addressing between the pixels and the blocks to the block averaging encoder 210. The block averaging encoder 210 may encode the accumulated stress value for the pixels into the accumulated stress value for the blocks based on the information on the addressing between the pixels and the blocks (e.g., based on which block a given pixel is located in).

The timing controller 200 may further include the scaler 201 for receiving the input image data IMG and changing scales of the input image data IMG. The scaler 201 outputs the input image data IMG which have the changed scales to the operator 202.

The timing controller 200 may further include the dithering part 207. The dithering part 207 receives the operating result between the input image data IMG and the deterioration compensating values, and dithers the operating result between the input image data IMG and the deterioration compensating values to generate the output image data DATA. The dithering part 207 outputs the output image data DATA to the data driver 400. In addition, the dithering part 207 may output the output image data DATA to the first converter 208. The output image data DATA may be referred to as the data signal DATA.

Figure 6:
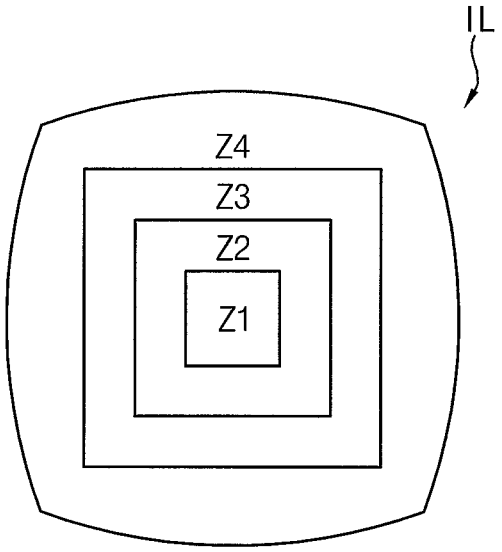
FIG. 6 is a conceptual diagram illustrating a display area and a plurality of zones of the display panel of FIG. 2.
Figure 7:
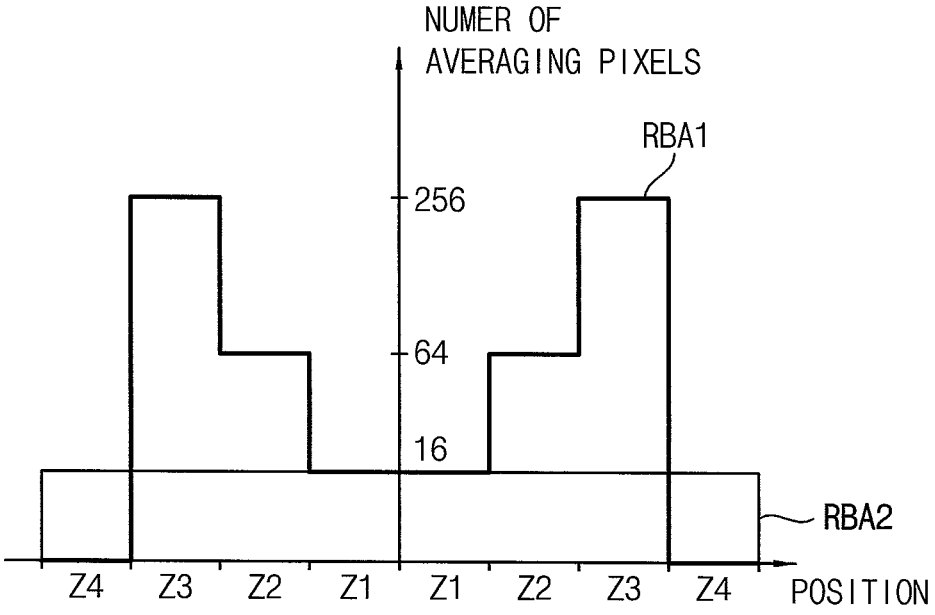
FIG. 7 is a graph illustrating a size of a block including red subpixels according to the zones of FIG. 6.
Figure 8:
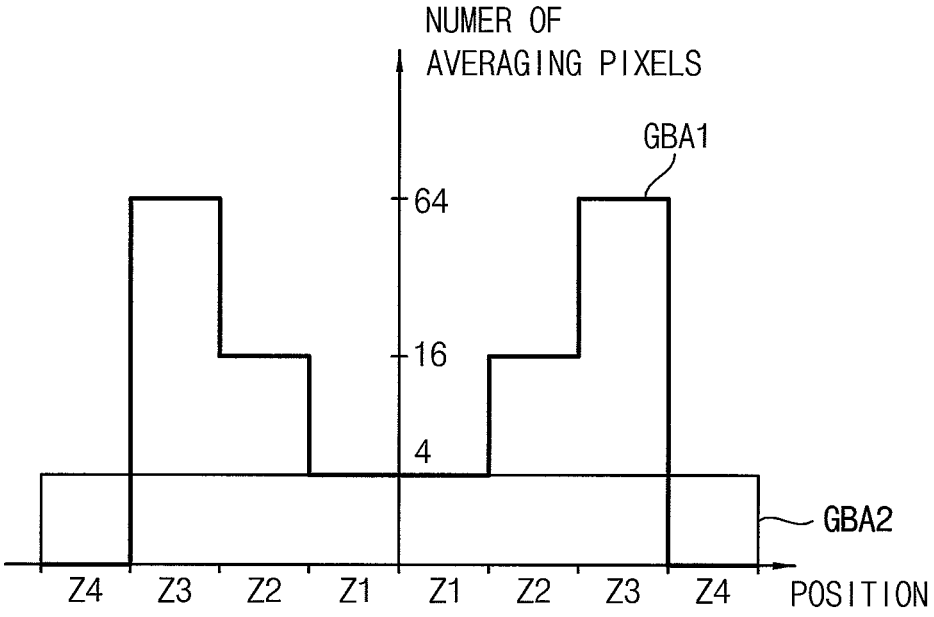
FIG. 8 is a graph illustrating a size of a block including green subpixels according to the zones of FIG. 6.

FIG. 6 is a conceptual diagram illustrating the display area and the plurality of the zones of the display panel 100 of FIG. 2. FIG. 7 is a graph illustrating the size of the block including red subpixels according to the zones of FIG. 6. FIG. 8 is a graph illustrating the size of the block including green subpixels according to the zones of FIG. 6.

Referring to FIGS. 1 to 8, in FIG. 6, the first display area IL of the display panel 100 of FIG. 4 may be divided into four zones. The first display area IL includes a first zone Z1 including the central portion of the first display area IL, a second zone Z2 adjacent to the first zone Z1 and spaced apart from the central portion of the first display area IL compared to the first zone Z1, a third zone Z3 adjacent to the second zone Z2 and spaced apart from the central portion of the first display area IL compared to the second zone Z2 and a fourth zone Z4 adjacent to the third zone Z3 and spaced apart from the central portion of the first display area IL compared to the third zone Z3.

For example, edges of the first zone Z1 may form a rectangle. For example, the edges of the first zone Z1 may form a square. Alternatively, the edges of the first zone Z1 form a closed loop which includes step-like lines extending along boundaries between the pixels such that the edges of the first zone Z1 have a substantially uniform distance from the central portion of the first zone Z1.

For example, edges of the second zone Z2 may form a rectangle. For example, the edges of the second zone Z2 may form a square. Alternatively, the edges of the second zone Z2 form a closed loop which includes step-like lines extending along boundaries between the pixels such that the edges of the second zone Z2 have a substantially uniform distance from the central portion of the first zone Z1.

A pixel of the display panel 100 may include red subpixels, green subpixels and blue subpixels. For example, a pixel of the display panel 100 may include one red subpixel, two green subpixels and one blue subpixel. Thus, the number of the green subpixels may be twice of the number of the red subpixels. The number of the blue subpixels may be equal to the number of the red subpixels.

For example, the stress value and the deterioration compensating value may be generated for the subpixels. When the number of the green subpixels is greater than the number of the red subpixels in the pixel, the size of the block of the red subpixels may be greater than the size of the block of the green subpixels. When the number of the green subpixels is twice of the number of the red subpixels in the pixel, the size of the block of the red subpixels may be quadruple of the size of the block of the green subpixels.

FIG. 7 illustrates the size of the block utilized to generate the stress value of the red subpixels in a block averaging method.

In a conventional block averaging method (RBA2), the size of the block is uniform regardless of the position in the display area. In the conventional block averaging method (RBA2), the size of the block may be sixteen pixels (e.g. four by four).

In a block averaging method (RBA1) according to the present exemplary embodiment, the size of the block varies according to the position in the display area. In the block averaging method (RBA1) according to the present exemplary embodiment, the size of the block may be sixteen pixels (e.g. four by four) in the first zone Z1, 64 pixels (e.g. eight by eight) in the second zone Z2 and 256 pixels (e.g. sixteen by sixteen) in the third zone Z3. In some embodiments of the block averaging method (RBA1) according to the present exemplary embodiment, no stress value or deterioration compensation value are generated for blocks in the fourth zone Z4 having low visibility according to human visual characteristics.

In the block averaging method (RBA1) according to the present exemplary embodiment, the size of the block varies according to the position in the display area. The size of a block in the first zone Z1 is same as the size of the block of the conventional block averaging method (RBA2) and the size of a block in the second zone Z2 and the third zone Z3 is greater than the size of the block of the conventional block averaging method (RBA2) so that the storage size of the internal memory 206 and the storage size of the external memory 500 for storing the stress value may be reduced. In addition, in some embodiments, no stress value is generated for the fourth zone Z4 considering human visual characteristics so that the storage size of the internal memory 206 and the storage size of the external memory 500 for storing the stress value may be further reduced.

FIG. 8 illustrates the size of the block utilized to generate the stress value of the green subpixels in the block averaging method.

In a conventional block averaging method (GBA2), the size of the block is uniform regardless of the position in the display area. In the conventional block averaging method (GBA2), the size of the block may be four pixels (e.g. two by two).

In a block averaging method (GBA1) according to the present exemplary embodiment, the size of the block varies according to the position in the display area. In the block averaging method (GBA1) according to the present exemplary embodiment, the size of the block may be four pixels (e.g. two by two) in the first zone Z1, sixteen pixels (e.g. four by four) in the second zone Z2 and 64 pixels (e.g. eight by eight) in the third zone Z3. In some embodiments of the block averaging method (GBA1) according to the present exemplary embodiment, no stress value or deterioration compensation value are generated in the fourth zone Z4 having the low visibility according to human visual characteristics.

In the block averaging method (GBA1) according to the present exemplary embodiment, the size of the block varies according to the position in the display area. The size of a block in the first zone Z1 is same as the size of the block of the conventional block averaging method (GBA2) and the size of a block in the second zone Z2 and the third zone Z3 is greater than as the size of the block of the conventional block averaging method (GBA2) so that the size of the storage size of the internal memory 206 and the storage size of the external memory 500 for storing the stress value may be reduced. In addition, in some embodiments, no stress value is generated for the fourth zone Z4 considering human visual characteristics so that the storage size of the internal memory 206 and the storage size of the external memory 500 for storing the stress value may be further reduced.

Although not shown in the figures, the size of the block of the green subpixels to generate the stress value of the green subpixels in the block averaging method may be substantially the same as the size of the block of the red subpixels as shown in FIG. 7.

FIG. 9 is a conceptual diagram illustrating a method of determining a deterioration compensating value for a pixel based on a deterioration compensating value for a block using the timing controller of FIG. 5.

Referring to FIGS. 1 to 9, the deterioration compensation value for the pixels to compensate the input image data IMG may be determined by bilinear interpolation of the deterioration compensation values of the four adjacent blocks.

In FIG. 9, when the deterioration compensation value of the pixel is P(a, b), a is a row direction coordinate in a plane defined by central points of the four adjacent blocks, b is a column direction coordinate in the plane defined by the central points of the four adjacent blocks, B1 is a deterioration compensating value of a first block, B2 is a deterioration compensating value of a second block adjacent to the first block in the row direction, B3 is a deterioration compensating value of a third block adjacent to the first block in the column direction, B4 is a deterioration compensating value of a fourth block adjacent to the third block in the row direction and, in some embodiments, adjacent to the second block in the column direction, r is the number of the rows of the blocks, c is the number of the columns of the blocks, T is a deterioration compensating value of first temporary coordinates between the central point of the first block and the central point of the third block and U is a deterioration compensating value of second temporary coordinates between the central point of the second block and the central point of the fourth block, following Equations 1 to 3 are satisfied.

$$P(a, b) = T\frac{c-b}{c} + U\frac{b}{c} \quad \text{Equation 1}$$

$$T = B1\frac{r-a}{r} + B3\frac{a}{r} \quad \text{Equation 2}$$

$$U = B2\frac{r-a}{r} + B4\frac{a}{r} \quad \text{Equation 3}$$

In FIG. 9, the number of the rows of the block is eight and the number of the columns of the block is eight.

Figure 10:
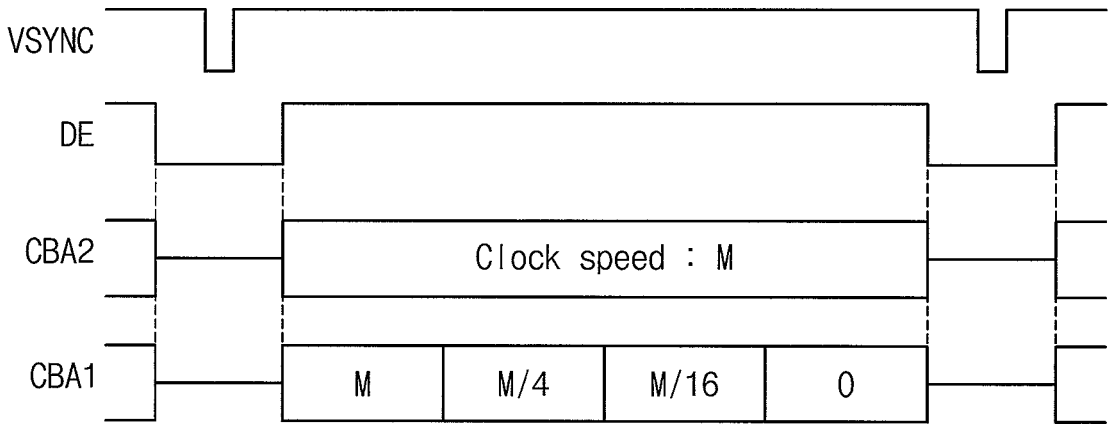
FIG. 10 is a timing diagram illustrating a clock speed of the data processed in the timing controller of FIG. 5.

FIG. 10 is a timing diagram illustrating a clock speed of the data processed in the timing controller 200 of FIG. 5.

Referring to FIGS. 1 to 10, in the conventional block averaging method (CBA2), the size of the block is uniform regardless of the position in the display area and accordingly the clock speed M to process the data is also uniform regardless of the position in the display area.

In the block averaging method (CBA1) according to the present exemplary embodiment, the block size varies according to the position in the display area. For example, when the size of the first zone Z1 is a quarter of the display area, the size of the second zone Z2 is a quarter of the display area, the size of the third zone Z3 is a quarter of the display area and the size of the fourth zone Z4 is a quarter of the display area, the clock speed of the first zone Z1 is same as the clock speed M of the conventional block averaging method (CBA2), the clock speed of the second zone Z2 is a quarter of the clock speed M of the conventional block averaging method (CBA2), the clock speed of the third zone Z3 is 1/16 of the clock speed M of the conventional block averaging method (CBA2) and the clock speed of the fourth zone Z4 is zero.

As the clock speed to process the data of the timing controller 200 decreases, the power consumption of the display apparatus may be reduced.

According to the present exemplary embodiment, the display area is divided into the plurality of zones, and the size of the block varies according to the zones so that the input image data IMG may be compensated. Thus, the display quality of the display apparatus which may be vulnerable to deterioration may be enhanced.

In addition, the size of the block is adjusted according to the zones so that the size of the memories 206 and 500 of the display apparatus may be reduced. Thus, the manufacturing cost of the display apparatus may be reduced.

In addition, the size of the block is adjusted according to the zones so that the quantity of data and a clock speed to process the data to compensate for the deterioration are reduced. Thus, the power consumption of the display apparatus may be reduced.

Figure 11:
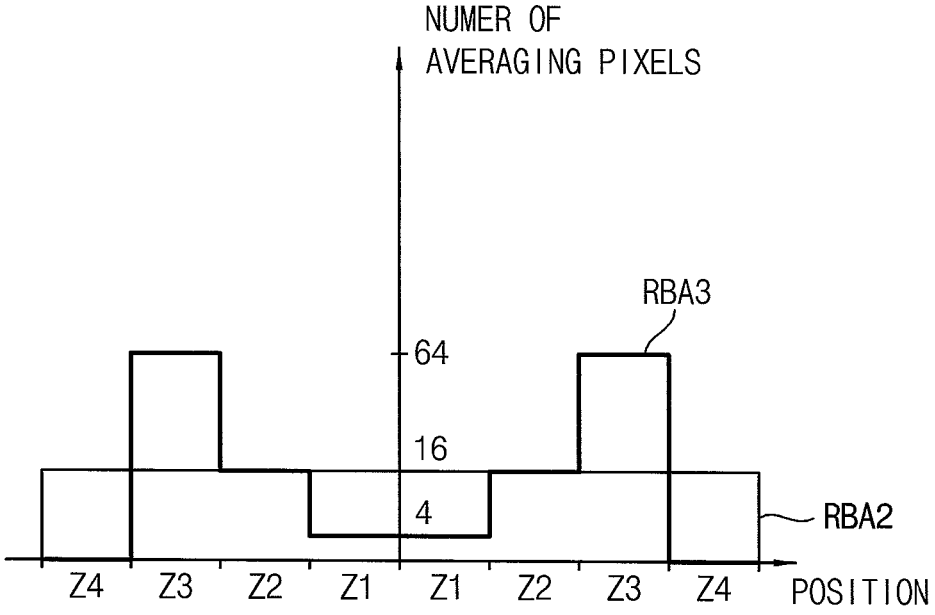
FIG. 11 is a graph illustrating a size of a block including red subpixels according to zones according to an exemplary embodiment of the present inventive concept.
Figure 12:
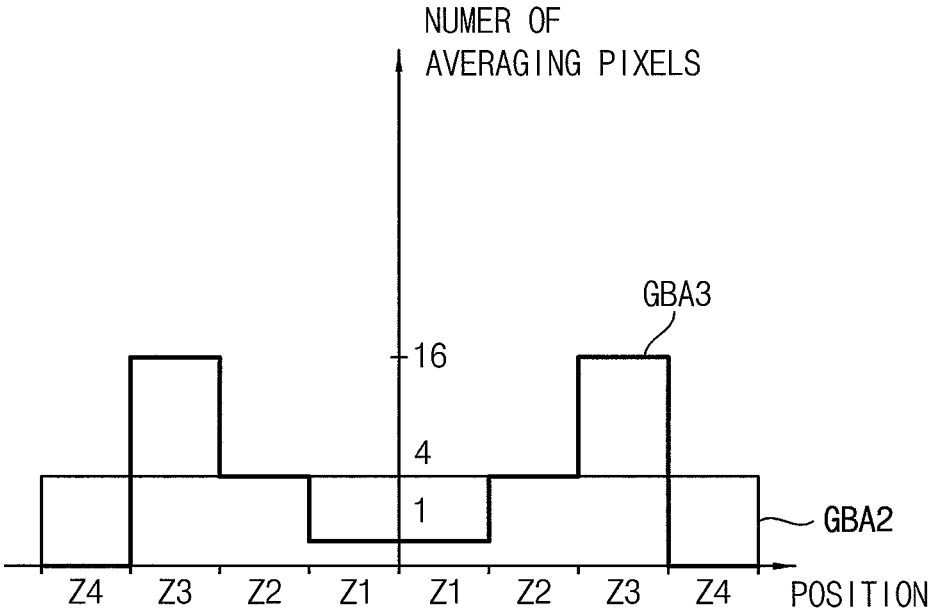
FIG. 12 is a graph illustrating a size of a block including green subpixels according to zones according to an exemplary embodiment of the present inventive concept.

FIG. 11 is a graph illustrating a size of a block including red subpixels according to zones according to an exemplary embodiment of the present inventive concept. FIG. 12 is a graph illustrating a size of a block including green subpixels according to zones according to an exemplary embodiment of the present inventive concept.

The deterioration compensation apparatus, the display apparatus and the method of compensating for deterioration according to the present exemplary embodiment may be substantially the same as the deterioration compensation apparatus, the display apparatus and the method of compensating for deterioration of the previous exemplary embodiment explained referring to FIGS. 1 to 10 except for the sizes of the blocks in the block averaging method. Thus, the same reference numerals will be used to refer to the same or like parts as those described in the previous exemplary embodiment of FIGS. 1 to 10 and repetitive explanation concerning the above elements may be omitted.

Referring to FIGS. 1 to 6 and 9 to 12, the display apparatus includes a display panel 100, a left eye lens LL and a right eye lens LR. For example, the display apparatus may be a head mounted display apparatus. The display apparatus may be mounted to a head of a user.

The display panel 100 displays an image.

The left eye lens LL is disposed between a left eye LE of the user and the display panel 100. The left eye lens LL refracts an image of a first display area of the display panel 100 and transmits the image of the first display area to the left eye LE of the user. For example, the left eye lens LL may magnify the image of the first display area and transmit the image of the first display area to the left eye LE of the user.

The right eye lens LR is disposed between a right eye RE of the user and the display panel 100. The right eye lens LR refracts an image of a second display area of the display panel 100 and transmits the image of the second display area to the right eye RE of the user. For example, the right eye lens LR may magnify the image of the second display area and transmit the image of the second display area to the right eye RE of the user.

In the present exemplary embodiment, the display apparatus may include a single display panel 100. The display panel 100 may include the first display area for displaying a left eye image and the second display area for displaying a right eye image.

The timing controller 200 includes the deterioration compensation part 250. The deterioration compensation apparatus of the present exemplary embodiment may include the deterioration compensation part 250 of the timing controller 200 and the external memory 500.

The deterioration compensation part 250 includes a zone determining part 211, a stress generating part and a stress compensation part.

The zone determining part 211 divides the display area into a plurality of zones based on a distance from the central portion of the display area.

The stress generating part generates a stress value of output image data for blocks (e.g., every block) including a plurality of pixels in the display area.

The external memory 500 connected to the timing controller 200 stores the accumulated stress values for the blocks.

The stress compensation part receives the accumulated stress values for the blocks and compensates the input image data in a unit of the pixel.

The size of a block may be defined as the number of pixels included in the block. The number of pixels included in a block may vary according to the zone of the display area which is determined by the zone determining part 211. For example, the number of the pixels included in a block of a zone may increase as the distance of the zone from the central portion of the display area increases.

In FIG. 6, the first display area IL of the display panel 100 of FIG. 4 may be divided into four zones. The first display area IL includes a first zone Z1 including the central portion of the first display area IL, a second zone Z2 adjacent to the first zone Z1 and spaced apart from the central portion of the first display area IL compared to the first zone Z1, a third zone Z3 adjacent to the second zone Z2 and spaced apart from the central portion of the first display area IL compared to the second zone Z2 and a fourth zone Z4 adjacent to the third zone Z3 and spaced apart from the central portion of the first display area IL compared to the third zone Z3.

A pixel of the display panel 100 may include red subpixels, green subpixels and blue subpixels. For example, a pixel of the display panel 100 may include one red subpixel, two green subpixels and one blue subpixel. Thus, the number of the green subpixels may be twice of the number of the red subpixels. The number of the blue subpixels may be equal to the number of the red subpixels.

For example, the stress value and the deterioration compensating value may be generated for the subpixels. When the number of the green subpixels is greater than the number of the red subpixels in the pixel, the size of the block of the red subpixels may be greater than the size of the block of the green subpixels. When the number of the green subpixels is twice of the number of the red subpixels in the pixel, the size of the block of the red subpixels may be quadruple of the size of the block of the green subpixels.

FIG. 11 illustrates the size of the block utilized to generate the stress value of the red subpixels in a block averaging method.

In a conventional block averaging method (RBA2), the size of the block is uniform regardless of the position in the display area. In the conventional block averaging method (RBA2), the size of the block may be sixteen pixels (e.g. four by four).

In a block averaging method (RBA3) according to the present exemplary embodiment, the size of the block varies according to the position in the display area. In the block averaging method (RBA3) according to the present exemplary embodiment, the size of the block may be four pixels (e.g. two by two) in the first zone Z1, 16 pixels (e.g. four by four) in the second zone Z2 and 64 pixels (e.g. eight by eight) in the third zone Z3. In the block averaging method (RBA1) according to the present exemplary embodiment, no stress value or deterioration compensation value are generated for blocks in the fourth zone Z4 having low visibility according to human visual characteristics.

In the block averaging method (RBA3) according to the present exemplary embodiment, the size of the block varies according to the position in the display area. The size of the block in the first zone Z1 is less than the size of the block of the conventional block averaging method (RBA2), the size of the block in the second zone Z2 is same as the size of the block of the conventional block averaging method (RBA2), and the size of the block in the third zone Z3 is greater than as the size of the block of the conventional block averaging method (RBA2) in the third zone Z3 so that the deterioration compensation function in the central portion of the display area may be enhanced and the storage size of the internal memory 206 and the storage size of the external memory 500 for storing the stress value may be reduced according to the dividing of the first to third zones Z1 to Z3. In addition, in some embodiments, no stress value is generated for the fourth zone Z4 considering human visual characteristics so that the storage size of the internal memory 206 and the storage size of the external memory 500 for storing the stress value may be further reduced.

FIG. 12 illustrates the size of the block utilized to generate the stress value of the green subpixels in the block averaging method.

In a conventional block averaging method (GBA2), the size of the block is uniform regardless of the position in the display area. In the conventional block averaging method (GBA2), the size of the block may be four pixels (e.g. two by two).

In a block averaging method (GBA3) according to the present exemplary embodiment, the size of the block varies according to the position in the display area. In the block averaging method (GBA1) according to the present exemplary embodiment, the size of the block may be one pixel (e.g. one by one) in the first zone Z1, four pixels (e.g. two by two) in the second zone Z2 and sixteen pixels (e.g. four by four) in the third zone Z3. In some embodiments of the block averaging method (GBA3) according to the present exemplary embodiment, no stress value or deterioration compensation value are generated for blocks in the fourth zone Z4 having low visibility according to human visual characteristics.

In the block averaging method (GBA3) according to the present exemplary embodiment, the size of the block varies according to the position in the display area. The size of the block in the first zone Z1 is less than the size of the block of the conventional block averaging method (GBA2), the size of the block in the second one Z2 is same as the size of the block of the conventional block averaging method (GBA2), and the size of the block in the third zone Z3 is greater than as the size of the block of the conventional block averaging method (GBA2) so that the deterioration compensation function in the central portion of the display area may be enhanced and the storage size of the internal memory 206 and the storage size of the external memory 500 for storing the stress value may be reduced according to the dividing of the first to third zones Z1 to Z3. In addition, in some embodiments, no stress value is generated for the fourth zone Z4 considering human visual characteristics so that the storage size of the internal memory 206 and the storage size of the external memory 500 for storing the stress value may be further reduced.

Although not shown in the figures, the size of the block of the green subpixels to generate the stress value of the green subpixels in the block averaging method may be substantially the same as the size of the block of the red subpixels as shown in FIG. 11.

According to the present exemplary embodiment, the display area is divided into the plurality of zones, and the size of the block varies according to the zones so that the input image data IMG may be compensated. Thus, the display quality of the display apparatus which may be vulnerable to deterioration may be enhanced.

In addition, the size of the block is adjusted according to the zones so that the size of the memories 206 and 500 of the display apparatus may be reduced. Thus, the manufacturing cost of the display apparatus may be reduced.

In addition, the size of the block is adjusted according to the zones so that the quantity of data and a clock speed to process the data to compensate for the deterioration are reduced. Thus, the power consumption of the display apparatus may be reduced.

Figure 13:
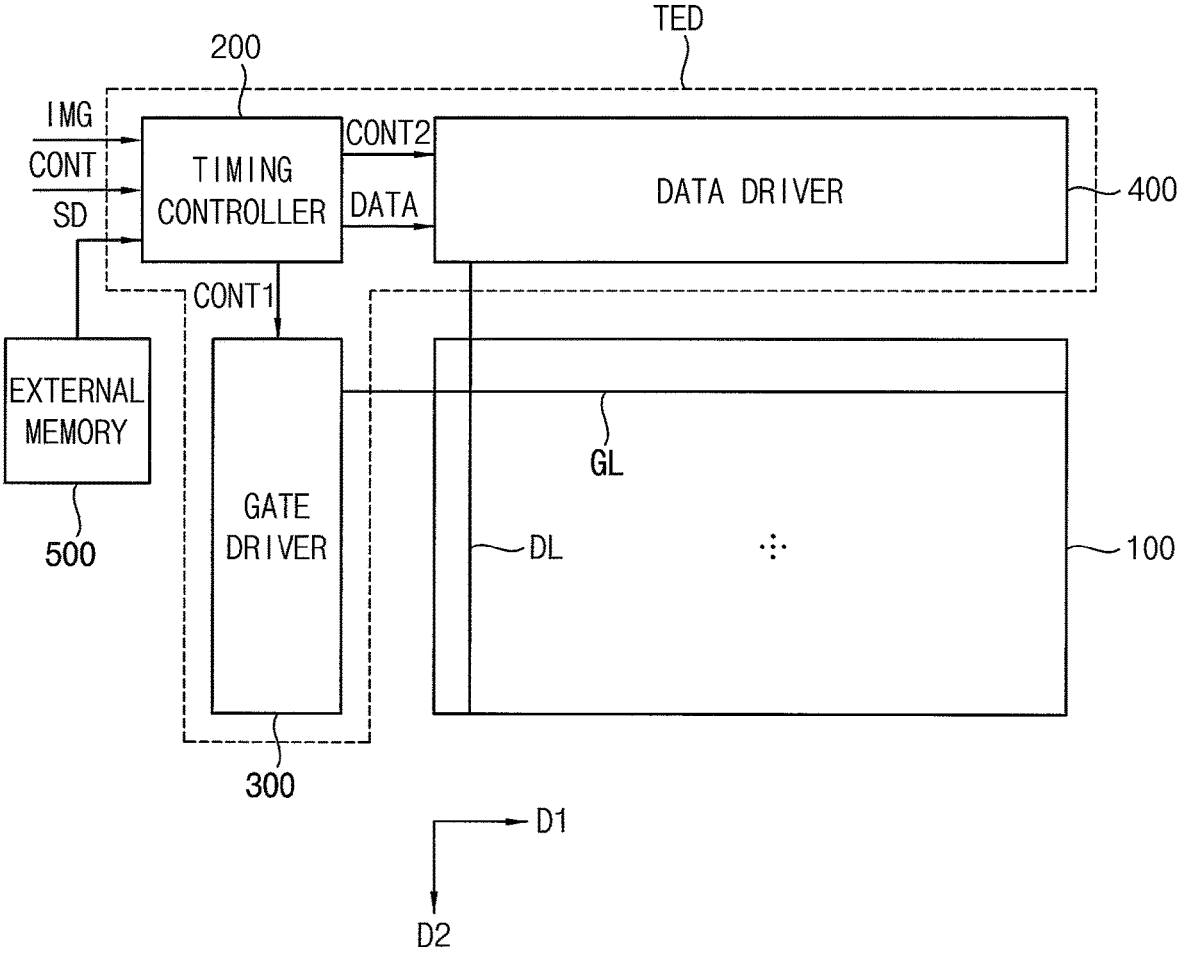
FIG. 13 is a block diagram illustrating a display apparatus according to an exemplary embodiment of the present inventive concept.

FIG. 13 is a block diagram illustrating a display apparatus according to an exemplary embodiment of the present inventive concept.

The deterioration compensation apparatus, the display apparatus and the method of compensating for deterioration according to the present exemplary embodiment may be substantially the same as the deterioration compensation apparatus, the display apparatus and the method of compensating for deterioration of the previous exemplary embodiment explained referring to FIGS. 1 to 10 except for the structures of the timing controller, the gate driver and the data driver. Thus, the same reference numerals will be used to refer to the same or like parts as those described in the previous exemplary embodiment of FIGS. 1 to 10 and repetitive explanation concerning the above elements may be omitted.

Referring to FIGS. 1, 3 to 10 and 13, the display apparatus includes a display panel 100, a left eye lens LL and a right eye lens LR. For example, the display apparatus may be a head mounted display apparatus. The display apparatus may be mounted to a head of a user.

The display panel 100 displays an image.

The left eye lens LL is disposed between a left eye LE of the user and the display panel 100. The left eye lens LL refracts an image of a first display area of the display panel 100 and transmits the image of the first display area to the left eye LE of the user. For example, the left eye lens LL may magnify the image of the first display area and transmit the image of the first display area to the left eye LE of the user.

The right eye lens LR is disposed between a right eye RE of the user and the display panel 100. The right eye lens LR refracts an image of a second display area of the display panel 100 and transmits the image of the second display area to the right eye RE of the user. For example, the right eye lens LR may magnify the image of the second display area and transmit the image of the second display area to the right eye RE of the user.

In the present exemplary embodiment, the display apparatus may include a single display panel 100. The display panel 100 may include the first display area for displaying a left eye image and the second display area for displaying a right eye image.

The display apparatus includes the display panel 100 and a display panel driver. The display panel driver includes a timing controller 200, a gate driver 300, a data driver 400 and an external memory 500. A deterioration compensation apparatus of the present exemplary embodiment may include the timing controller 200 and the external memory 500.

In the present exemplary embodiment, the timing controller 200, the gate driver 300 and the data driver 400 may be formed on a single chip. For example, the timing controller 200, the gate driver 300 and the data driver 400 may be referred as an integrated driver TED. In addition, the integrated driver TED may be referred as a timing controller embedded data driver TED.

The display apparatus may be the head mounted display apparatus. The head mounted display apparatus is applied to a human body so that the size of the apparatus and the weight of the apparatus may have limitations.

The display apparatus includes the integrated driver TED which is formed as the single chip so that the size of the apparatus and the weight of the apparatus may be reduced compared to the conventional head mounted display apparatus.

The timing controller 200 includes the deterioration compensation part 250. The deterioration compensation apparatus of the present exemplary embodiment may include the deterioration compensation part 250 of the timing controller 200 and the external memory 500.

According to the present exemplary embodiment, the display area is divided into the plurality of zones, and the size of the block varies according to the zones so that the input image data IMG may be compensated. Thus, the display quality of the display apparatus which may be vulnerable to deterioration may be enhanced.

In addition, the size of the block is adjusted according to the zones so that the size of the memories 206 and 500 of the display apparatus may be reduced. Thus, the manufacturing cost of the display apparatus may be reduced.

In addition, the size of the block is adjusted according to the zones so that the quantity of data and a clock speed to process the data to compensate for the deterioration are reduced. Thus, the power consumption of the display apparatus may be reduced.

Figure 14:
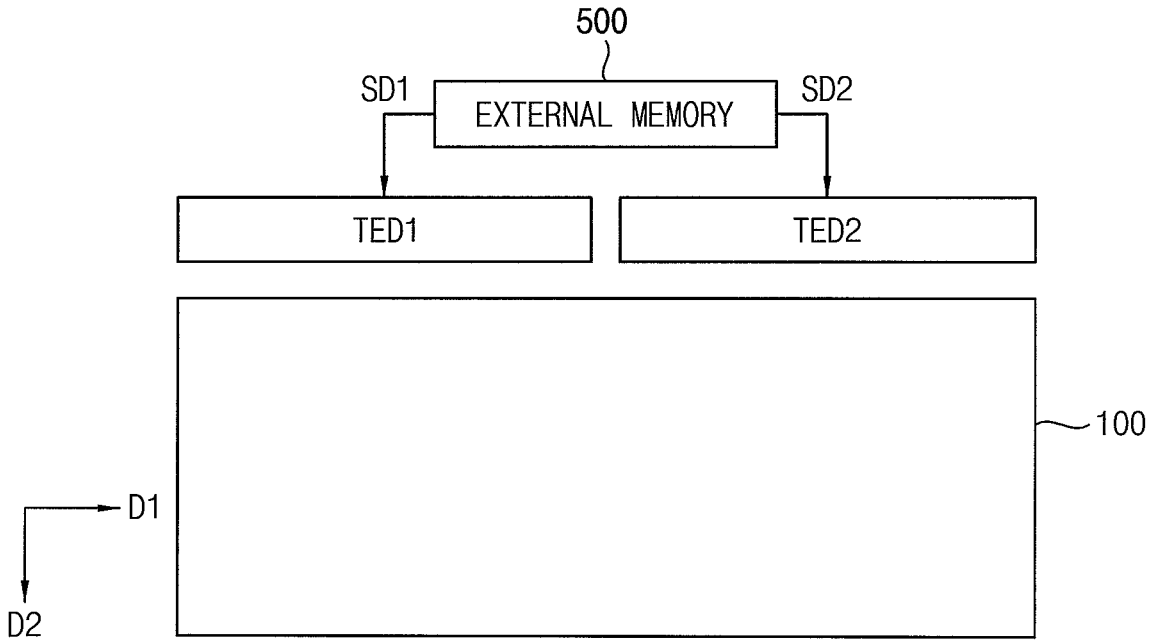
FIG. 14 is a block diagram illustrating a display apparatus according to an exemplary embodiment of the present inventive concept.

FIG. 14 is a block diagram illustrating a display apparatus according to an exemplary embodiment of the present inventive concept.

The deterioration compensation apparatus, the display apparatus and the method of compensating for deterioration according to the present exemplary embodiment may be substantially the same as the deterioration compensation apparatus, the display apparatus and the method of compensating for deterioration of the previous exemplary embodiment explained referring to FIGS. 1 to 10 except for the structures of the timing controller, the gate driver and the data driver. Thus, the same reference numerals will be used to refer to the same or like parts as those described in the previous exemplary embodiment of FIGS. 1 to 10 and repetitive explanation concerning the above elements may be omitted.

Referring to FIGS. 1, 3 to 10 and 14, the display apparatus includes a display panel 100, a left eye lens LL and a right eye lens LR. For example, the display apparatus may be a head mounted display apparatus. The display apparatus may be mounted to a head of a user.

The display panel 100 displays an image.

The left eye lens LL is disposed between a left eye LE of the user and the display panel 100. The left eye lens LL refracts an image of a first display area of the display panel 100 and transmits the image of the first display area to the left eye LE of the user. For example, the left eye lens LL may magnify the image of the first display area and transmit the image of the first display area to the left eye LE of the user.

The right eye lens LR is disposed between a right eye RE of the user and the display panel 100. The right eye lens LR refracts an image of a second display area of the display panel 100 and transmits the image of the second display area to the right eye RE of the user. For example, the right eye lens LR may magnify the image of the second display area and transmit the image of the second display area to the right eye RE of the user.

In the present exemplary embodiment, the display apparatus may include a single display panel 100. The display panel 100 may include the first display area for displaying a left eye image and the second display area for displaying a right eye image.

The display apparatus includes the display panel 100 and a display panel driver. In the present exemplary embodiment, the display apparatus includes the single display panel 100 and two display panel drivers TED1 and TED2.

The display panel driver may include a first integrated driver TED1 and a second integrated driver TED2. The first integrated driver TED1 may drive a first display area of the display panel 100 (e.g., the first display area for displaying the left eye image). The second integrated driver TED2 may drive a second display area of the display panel 100 (e.g., the second display area for displaying the right eye image).

Like the embodiment depicted in FIG. 13, the first integrated driver TED1 may include a first timing controller, a first gate driver and a first data driver which are formed on a single chip. The first integrated driver TED1 may be referred as a first timing controller embedded data driver. Similarly, the second integrated driver TED2 may include a second timing controller, a second gate driver and a second data driver which are formed on a single chip. The second integrated driver TED2 may be referred as a second timing controller embedded data driver.

The first integrated driver TED1 includes a first deterioration compensation part to compensate for the deterioration of the first display area. The second integrated driver TED2 includes a second deterioration compensation part to compensate for the deterioration of the second display area. The deterioration compensation apparatus of the present exemplary embodiment may include the first deterioration compensation part of the first integrated driver TED1, the second deterioration compensation part of the second integrated driver TED2 and the external memory 500.

According to the present exemplary embodiment, the display area is divided into the plurality of zones, and the size of the block varies according to the zones so that the input image data IMG may be compensated. Thus, the display quality of the display apparatus which may be vulnerable to deterioration may be enhanced.

In addition, the size of the block is adjusted according to the zones so that the size of the memories 206 and 500 of the display apparatus may be reduced. Thus, the manufacturing cost of the display apparatus may be reduced.

In addition, the size of the block is adjusted according to the zones so that the quantity of data and a clock speed to process the data to compensate for the deterioration are reduced. Thus, the power consumption of the display apparatus may be reduced.

Figure 15:
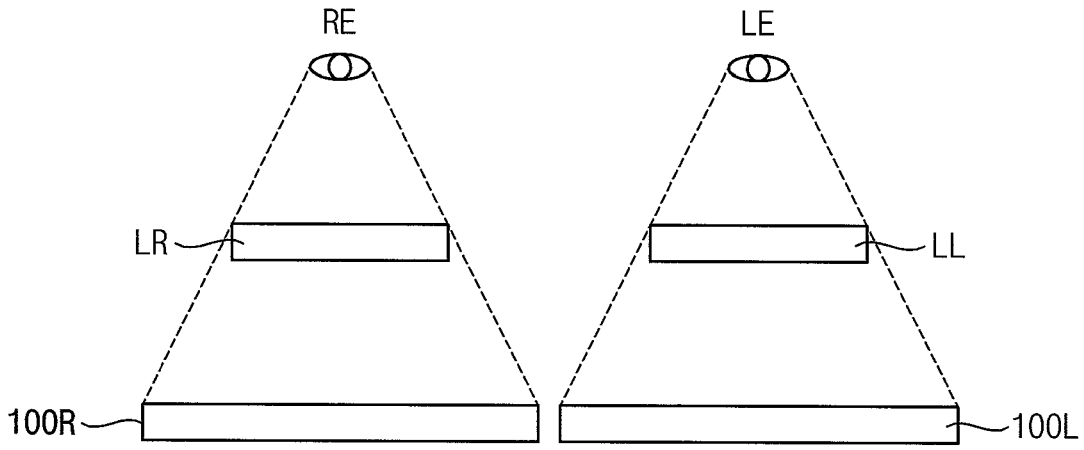
FIG. 15 is a conceptual diagram illustrating a display apparatus according to an exemplary embodiment of the present inventive concept.
Figure 16:
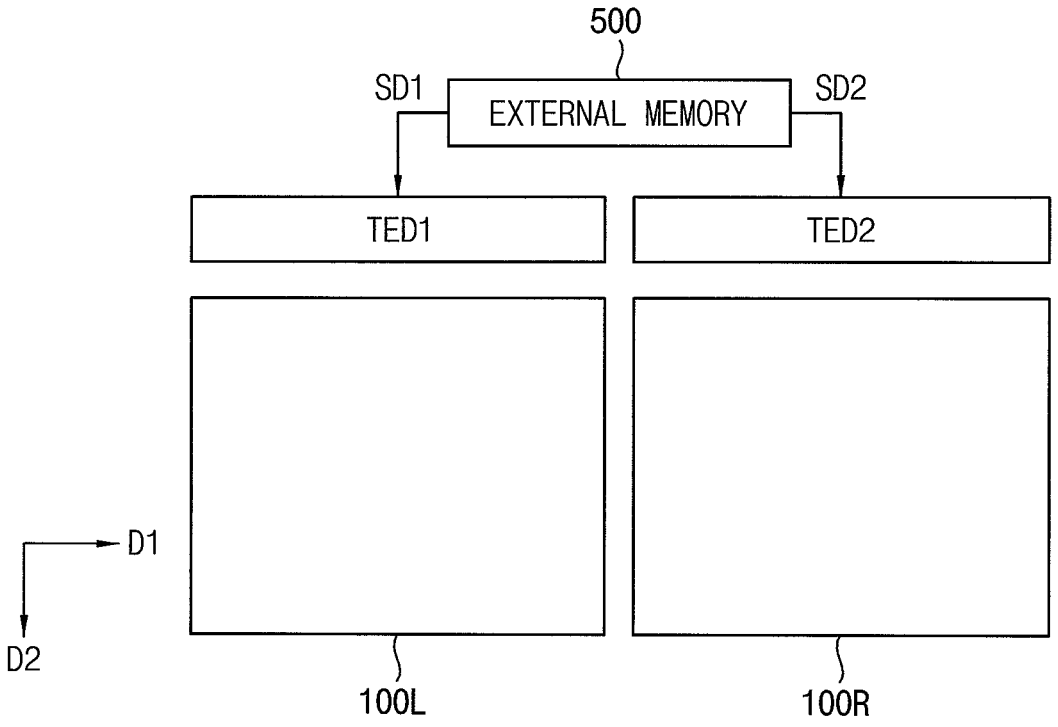
FIG. 16 is a block diagram illustrating a display apparatus of FIG. 15.

FIG. 15 is a conceptual diagram illustrating a display apparatus according to an exemplary embodiment of the present inventive concept. FIG. 16 is a block diagram illustrating a display apparatus of FIG. 15.

The deterioration compensation apparatus, the display apparatus and the method of compensating for deterioration according to the present exemplary embodiment may be substantially the same as the deterioration compensation apparatus, the display apparatus and the method of compensating for deterioration of the previous exemplary embodiment explained referring to FIGS. 1 to 10 except for the structures of the display panel, the timing controller, the gate driver and the data driver.

Thus, the same reference numerals will be used to refer to the same or like parts as those described in the previous exemplary embodiment of FIGS. 1 to 10 and repetitive explanation concerning the above elements may be omitted.

Referring to FIGS. 1, 3 to 10, 15 and 16, the display apparatus includes a first display panel 100L and a second display panel 100R, a left eye lens LL and a right eye lens LR. For example, the display apparatus may be a head mounted display apparatus. The display apparatus may be mounted to a head of a user.

The first display panel 100L displays a left eye image. The second display panel 100R displays a right eye image.

The left eye lens LL is disposed between a left eye LE of the user and the first display panel 100L. The left eye lens LL refracts an image of the first display panel 100L and transmits the image of the first display panel 100L to the left eye LE of the user. For example, the left eye lens LL may magnify the image of the first display panel 100L and transmit the image of the first display panel 100L to the left eye LE of the user.

The right eye lens LR is disposed between a right eye RE of the user and the second display panel 100R. The right eye lens LR refracts an image of the second display panel 100R and transmits the image of the second display panel 100R to the right eye RE of the user. For example, the right eye lens LR may magnify the image of the second display panel 100R and transmit the image of the second display panel 100R to the right eye RE of the user.

The display apparatus includes the display panels 100L and 100R, and the display panel driver. In the present exemplary embodiment, the display apparatus includes two display panels 100L and 100R and two display panel drivers TED1 and TED2.

The display panel driver may include a first integrated driver TED1 and a second integrated driver TED2. The first integrated driver TED1 may drive the first display panel 100L. The second integrated driver TED2 may drive the second display panel 100R.

Like the embodiment depicted in FIG. 13, the first integrated driver TED1 may include a first timing controller, a first gate driver and a first data driver which are formed on a single chip. The first integrated driver TED1 may be referred as a first timing controller embedded data driver. Similarly, the second integrated driver TED2 may include a second timing controller, a second gate driver and a second data driver which are formed on a single chip. The second integrated driver TED2 may be referred as a second timing controller embedded data driver.

The first integrated driver TED1 includes a first deterioration compensation part to compensate for the deterioration of the first display panel 100L. The second integrated driver TED2 includes a second deterioration compensation part to compensate for the deterioration of the second display panel 100R. The deterioration compensation apparatus of the present exemplary embodiment may include the first deterioration compensation part of the first integrated driver TED1, the second deterioration compensation part of the second integrated driver TED2 and the external memory 500.

According to the present exemplary embodiment, the display area is divided into the plurality of zones, and the size of the block varies according to the zones so that the input image data IMG may be compensated. Thus, the display quality of the display apparatus which may be vulnerable to deterioration may be enhanced.

In addition, the size of the block is adjusted according to the zones so that the size of the memories 206 and 500 of the display apparatus may be reduced. Thus, the manufacturing cost of the display apparatus may be reduced.

In addition, the size of the block is adjusted according to the zones so that the quantity of data and a clock speed to process the data to compensate for the deterioration are reduced. Thus, the power consumption of the display apparatus may be reduced.

According to the exemplary embodiments of the deterioration compensation apparatus, the display apparatus including the deterioration compensation apparatus and the method of compensating the deterioration, the size of the block varies according to the zones so that the input image data IMG may be compensated. Thus, the display quality of the display apparatus may be enhanced, the manufacturing cost of the display apparatus may be reduced and the power consumption of the display apparatus may be reduced.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and features of the present inventive concept.

Accordingly, all such modifications are intended to be included within the scope of the present inventive concept as defined in the claims. In the claims, means-plus-function clauses are intended to cover the structures described herein as performing the recited function and also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A deterioration compensation apparatus comprising:

a zone determiner configured to divide a display area into zones based on a distance from a central portion of the display area;

a stress generator configured to generate stress values of output image data for blocks including a plurality of pixels in the display area;

a first memory configured to accumulate the stress values of the output image data for the blocks and to store the accumulated stress values of the output image data for the blocks; and a stress compensator configured to receive the accumulated stress values of the output image data for the blocks and compensates input image data in a unit of pixels, wherein a number of the pixels included in a block of the blocks varies according to the zone in which the pixels included in the block are located.

2. The deterioration compensation apparatus of claim 1, wherein the number of the pixels included in a block of the blocks increases as the distance from the central portion of the display area increases.

3. The deterioration compensation apparatus of claim 1, further comprising a second memory configured to receive the accumulated stress values of the output image data for the blocks from the first memory and to transmit the accumulated stress values of the output image data for the blocks to the stress compensator.

4. The deterioration compensation apparatus of claim 3, wherein the first memory is a nonvolatile memory, and the second memory is a volatile memory.

5. The deterioration compensation apparatus of claim 4, wherein a storage size of the first memory is greater than a storage size of the second memory.

6. The deterioration compensation apparatus of claim 1, further comprising a block averaging addressing part configured to determine a size of the block according to the zone in which the block is located, and to address the pixels to the block based on the size of the block.

7. The deterioration compensation apparatus of claim 6, wherein the stress compensator comprises:

a block averaging decoder configured to receive the accumulated stress values of the output image data for the blocks and to decode the accumulated stress values of the output image data for the blocks into accumulated stress values of the output image data for the pixels;

a usage determiner configured to convert the accumulated stress values of the output image data for the pixels into usages of light emitting elements in the display area;

a compensating value determiner configured to generate deterioration compensating values for the pixels based on the usages of light emitting elements; and an operator configured to adjust the input image data based on the deterioration compensating values.

8. The deterioration compensation apparatus of claim 7, wherein the block averaging addressing part is configured to provide information on addressing between the pixels and the blocks to the block averaging decoder.

9. The deterioration compensation apparatus of claim 7, wherein the deterioration compensating value for the pixel to compensate the input image data is determined by bilinear interpolation of the deterioration compensation values of four adjacent blocks.

10. The deterioration compensation apparatus of claim 9, wherein when the deterioration compensation value of the pixel is P(a, b), a is a row direction coordinate in a plane defined by central points of the four adjacent blocks, b is a column direction coordinate in the plane defined by the central points of the four adjacent blocks, B1 is a deterioration compensating value of a first block, B2 is a deterioration compensating value of a second block adjacent to the first block in the row direction, B3 is a deterioration compensating value of a third block adjacent to the first block in the column direction, B4 is a deterioration compensating value of a fourth block adjacent to the third block in the row direction and adjacent to the second block in the column direction, r is the number of the rows of the blocks, c is the number of the columns of the blocks, T is a deterioration compensating value of first temporary coordinates between the central point of the first block and the central point of the third block and U is a deterioration compensating value of second temporary coordinates between the central point of the second block and the central point of the fourth block, $$P(a, b) = T\frac{c-b}{c} + U\frac{b}{c},\ T = B1\frac{r-a}{r} + B3\frac{a}{r} \text{ and } U = B2\frac{r-a}{r} + B4\frac{a}{r}.$$

11. The deterioration compensation apparatus of claim 6, wherein the stress generator comprises:

a first converter configured to receive the output image data and to convert the output image data into luminance values for the pixels;

a second converter configured to convert the luminance values for the pixels into the stress values of the output image data for the pixels using an accelerating factor; and a block averaging encoder configured to encode the stress values of the output image data for the pixels into the stress values of the output image data for the blocks.

12. The deterioration compensation apparatus of claim 11, wherein the block averaging addressing part provides information on addressing between the pixels and the blocks to the block averaging encoder.

13. The deterioration compensation apparatus of claim 11, wherein the accelerating factor includes a temperature of a display panel and/or a driving voltage of the display panel.

14. A display apparatus comprising:

a display panel configured to display an image;

a deterioration compensation apparatus comprising a stress generator configured to generate stress values of output image data of the display panel, a first memory configured to accumulate the stress values of the output image data and to store the accumulated stress values of the output image data, a stress compensator configured to compensate input image data based on the accumulated stress values of the output image data, and a second memory configured to receive the accumulated stress values of the output image data from the first memory and to transmit the accumulated stress values of the output image data to the stress compensator;

a gate driver configured to output a gate signal to the display panel; and a data driver configured to convert the output image data into a data voltage and to output the data voltage to the display panel.

15. The display apparatus of claim 14, wherein the deterioration compensation apparatus further comprises a zone determiner configured to divide a display area into zones based on a distance from a central portion of the display area.

16. The display apparatus of claim 15, wherein the stress generator is configured to generate the stress values of the output image data for blocks including a plurality of pixels in the display area, wherein the first memory is configured to accumulate the stress values of the output image data for the blocks, wherein the stress compensator is configured to compensate the input image data in a unit of the pixels, and wherein a number of the pixels included in a block of the blocks varies according to the zone in which the pixels included in the block are located.

17. The display apparatus of claim 16, wherein the number of the pixels included in the block increases as the distance from the central portion of the display area increases.

18. The display apparatus of claim 16, wherein the deterioration compensation apparatus further comprises a block averaging addressing part configured to determine a size of the block according to the zone in which the block is located, and to address the pixels to the block based on the size of the block.

19. The display apparatus of claim 18, wherein the stress compensator comprises:

a block averaging decoder configured to receive the accumulated stress values of the output image data for the blocks and to decode the accumulated stress values of the output image data for the blocks into accumulated stress values of the output image data for the pixels;

a usage determiner configured to convert the accumulated stress values of the output image data for the pixels into usages of light emitting elements in the display area;

a compensating value determiner configured to generate deterioration compensating values for the pixels based on the usages of light emitting elements; and an operator configured to adjust the input image data based on the deterioration compensating values.

20. The display apparatus of claim 18, wherein the stress generator comprises:

a first converter configured to receive the output image data and to convert the output image data into luminance values for the pixels;

a second converter configured to convert the luminance values for the pixels into the stress values of the output image data for the pixels using an accelerating factor; and a block averaging encoder configured to encode the stress values of the output image data for the pixels into the stress values of the output image data for the blocks.

21. The display apparatus of claim 15, wherein the zone determiner, the stress generator, the stress compensator, the gate driver and the data driver are formed on a single chip.

22. The display apparatus of claim 14, wherein the display panel comprises a left eye display area and a right eye display area, further comprising:

a left eye lens configured to be between the left eye display area and a left eye of a user; and a right eye lens configured to be between the right eye display area and a right eye of the user.

23. The display apparatus of claim 14, further comprising:

a second display panel spaced apart from the display panel;

a left eye lens configured to be between the display panel and a left eye of a user; and a right eye lens configured to be between the second display panel and a right eye of the user.

* * * * *